US005520344A

United States Patent [19]

Fey et al.

[11] Patent Number: 5,520,344

[45] Date of Patent: May 28, 1996

[54] APPARATUS FOR THE COMMINUTION OF SUSPENDED FIBRE MATERIAL

[75] Inventors: Juergen Fey, Ravensburg-Obereschach; Frank-Peter Meltzer, Daisendorf, both of Germany

[73] Assignee: Sulzer-Escher Wyss GmbH, Ravensburg, Germany

[21] Appl. No.: 181,682

[22] Filed: Jan. 14, 1994

[30] Foreign Application Priority Data

Jan. 19, 1993 [DE] Germany ..... 43 01 281.7

[51] Int. Cl.[6] ..... B02C 7/12; B02C 7/14

[52] U.S. Cl. ..... 241/259.1; 241/261.1; 241/285.3; 241/294

[58] Field of Search ..... 241/251, 259, 241/259.1, 259.3, 261.1, 285.2, 285.3, 294

[56] References Cited

U.S. PATENT DOCUMENTS

| | | | |
|---|---|---|---|
| 351,617 | 10/1886 | Anderson | 241/261.1 X |
| 1,217,528 | 2/1917 | Thom | 241/261.1 X |
| 3,428,262 | 2/1969 | Danforth | 241/261.1 X |

FOREIGN PATENT DOCUMENTS

| | | | |
|---|---|---|---|
| 1105327 | 6/1955 | France | 241/261.1 |
| 1109759 | 9/1955 | France | 241/261.1 |
| 7994 | 5/1956 | Germany | 241/261.1 |
| 2436482 | 2/1976 | Germany | 41/259 |
| 111345 | 8/1925 | Switzerland | 241/259.3 |

*Primary Examiner*—Timothy V. Eley
*Attorney, Agent, or Firm*—Townsend and Townsend and Crew

[57] ABSTRACT

An apparatus for the comminution of suspended fibre materials is described in which the fibre material is led through milling gaps which are formed between rotor and stator surfaces occupied with milling tools. The rotor which is floatingly journalled at one end has two conical surfaces equipped with milling tools, with the conical surfaces cooperating with complementary counter surfaces of fixed location which are likewise equipped with milling tools to form radially spaced apart milling gaps which extend substantially over the same axial range, or axially sequential conical milling gaps which enlarge in diameter towards the center of the rotor.

16 Claims, 4 Drawing Sheets

APPARATUS FOR THE COMMINUTION OF SUSPENDED FIBRE MATERIAL

BACKGROUND OF THE INVENTION

The invention relates to an apparatus for the comminution of suspended fibre material, in particular for the milling of paper fibres and/or of cellulose fibres. These apparatuses typically comprise a housing having inlet and outlet openings for the fibre material, a driveable rotor with a conical outer surface and a stator with a counter surface complementary to the rotor outer surface, with the rotor outer surface and the stator counter surface being at least predominantly occupied by milling tools to form a milling gap through which the fibre material flows and with both surfaces being adjustable relative to one another.

Pieces of apparatus of this kind, which are termed refiners, are known, and indeed with both milling gaps formed between conical surfaces and also with milling gaps formed between disc-like surfaces. An apparatus of this kind is, for example, described in DE 38 37 766 C2 which is incorporated herein by reference.

The so-called double disc and cone refiners are most frequently used for the milling of fibrous materials in the chemical pulp and paper industries.

With the increasing use of waste paper and short-fibre pulps, it is necessary to design comminution devices and refiners in such a way that a sensitive treatment of the fibrous materials is ensured, with the term sensitive treatment or caring milling being understood to mean a particularly pronounced preservation of the fibre length. As a rule milling machines with a larger number of knives bring about a more caring milling process.

In known cone refiners, the groove surfaces, i.e. the surfaces disposed between the knives, must normally be selected to be larger than in disc refiners because the centrifugal forces necessary to achieve the required hydraulic throughputs are smaller than in disc refiners. This leads to a reduction of the total knife length related to the conical surface and this can, in turn, lead to a corresponding reduction of the transmittable milling power. A disadvantage in the known cone refiners is furthermore that undesirably high axial forces act on the rotor bearing.

SUMMARY OF THE INVENTION

It is the object of the invention to form an apparatus of the initially named kind in such a way that a particularly caring treatment of the respective fibre materials is possible and simultaneously a substantial increase in the hydraulic capacity is achieved, while at the same time enlarging the possible fields of use. Moreover, the space requirement or the mounting surface which is required should be reduced in relation to the achievable output and the occurrence of undesired axial forces which act on the bearing should be precluded.

This object is satisfied in accordance with the invention essentially in that the rotor, which is floatingly journalled at one end, has two conical surfaces equipped with milling tools which are radially spaced apart from complementary rotationally fixed counter surfaces, which are likewise equipped with milling tools, thus forming milling gaps which extend substantially over the same axial range.

In accordance with an alternative embodiment, axially sequential conical milling gaps which enlarge in diameter towards the rotor can also be formed between the rotor and the rotationally fixed counter surfaces.

Through the invention, a double-cone refiner is thus provided with the conical surfaces and the milling gaps being arrange inside one another in the one case and being arranged in series after one another with opposite inclination in the other case, thereby doubling the available knife-edge length results in comparison to known arrangements This in turn has the consequence of a substantially more sensitive treatment of the fibre materials and ensures a broadening of the field of use with an increase of the hydraulic capacity.

In particular the embodiment with milling gaps arranged inside one another leads to a machine erection surface which is substantially reduced relative to the achievable power.

The fibre material guidance can take place either in parallel or in series with regard to the two milling gaps which are respectively present. The parallel material guidance with a flow direction along the cones from radially inward to radially outward is preferably selected.

In accordance with a further embodiment of the invention the hollow conical rotor and the counter surfaces associated with its inner and outer surfaces are arranged in a housing region which is at least of two-part design and can be swung open to expose the milling tools.

In this way it is ensured that the apparatus can be rapidly opened for cleaning purposes and to enable interchange of the milling tools, and also closed again, with the milling tools being freely accessible in the open state, so that blockages can be removed at once or worn milling tools can be exchanged, or a conversion can take place to other milling conditions through the use of correspondingly adapted milling tools.

In order to avoid the discharge line having to be removed at the flange on opening the apparatus, provision is made, in accordance with one embodiment of the invention, for the inlet opening and also the outlet opening for the fibrous material to be arranged in the fixed part of the housing. To achieve this, a connection duct, or a corresponding housing channel is provided in the housing part which can be swung open, the connection duct leading from the milling gap outlets to the outlet opening.

In a variant of the invention which is characterised by its particular simplicity, the housing region which can be swung open is formed by a hood-like pivotable lid which is pivotally connected to the fixed housing via hinges and which simultaneously serves as a carrier for the stator. In order to facilitate the outward pivoting procedure, a mechanism for axial displacement of the stator is integrated into the unit consisting of the pivotal lid and the stator. This mechanism generates the contact pressure in the milling gap in operation. Moreover, the stator can be moved in the direction towards the pivotal lid for the opening of the machine and thus space is provided for a simple outward pivotal movement. The total stroke of the possible stator displacement in the pivotal lid is thereby so selected that both functions, namely the pressing function and the opening function, can be ideally satisfied.

In accordance with a preferred embodiment of the invention, provision is made for the outwardly pivotable housing region to be formed of two housing parts which are pivotally connected to the fixed housing, in particular housing halves, and of the pivotal lid which carries the inner stator and is hinged to one of the housing halves, with each housing half carrying one half of the outer stator which is formed in two parts and associated with the outer milling gap.

In this way the milling tools of both milling gaps are freely accessible and can be correspondingly simply cleaned and also exchanged without a release or withdrawal of the rotor being necessary.

The subject of the invention also includes specially shaped milling tools for the described apparatus and these milling tools are characterised by a conical segment-like shape with quick coupling members at the rear side remote from the milling surface which can be latched in form-fitted manner with fixing bolts provided at the respective mounting surface.

Through this layout of the milling tools, it is ensured that a reduction of the knife surface available for milling due to the mounting means is avoided and accordingly the high knife-edge total length at the milling surface that is aimed at is obtained. Moreover, the rapid coupling system formed at the rear side of the conical segment-like milling tools reduces the required interchange times and thus contributes to increasing the economy of the overall apparatus.

BRIEF DESCRIPTION OF THE DRAWINGS

The invention will now be explained in detail with reference to embodiments and to the drawing in which are shown.

Figure 1:
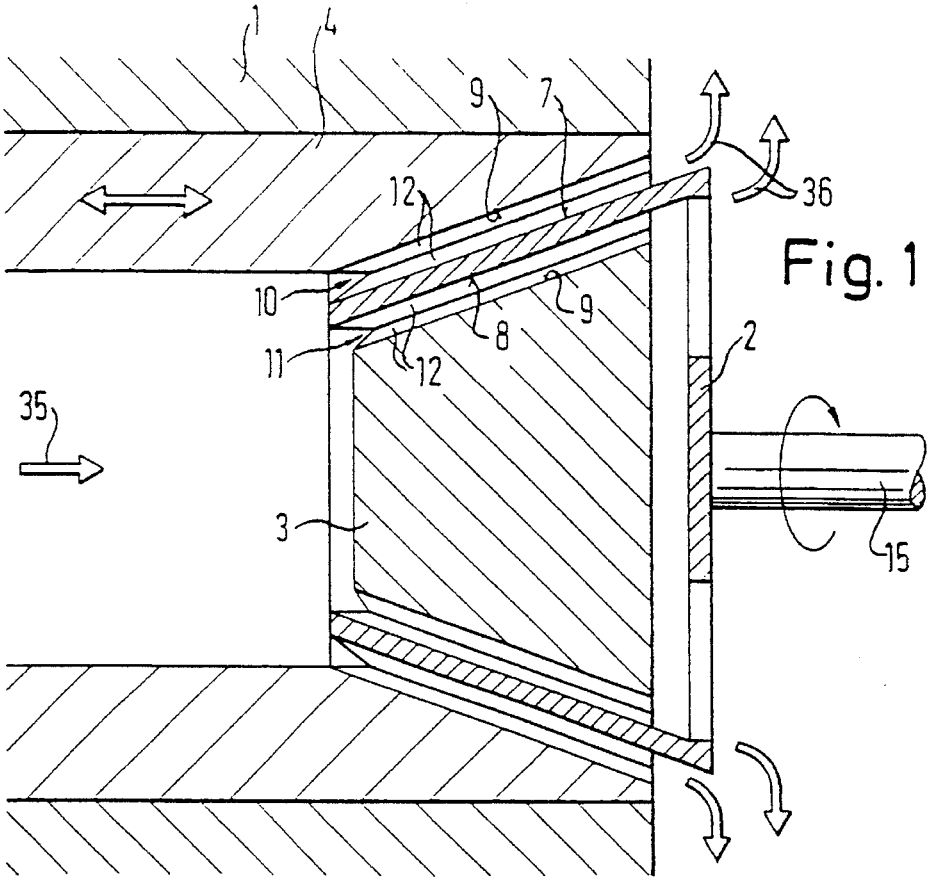
FIG. 1 a schematic illustration of a first embodiment of a double cone refiner with a stationary stator and an adjustable housing insert, FIG. 2 a second embodiment of a double cone refiner in accordance with the invention with an axially adjustable stator, FIG. 3 a third embodiment of a double cone refiner in accordance with the invention with essentially symmetrically arranged milling cone surfaces the diameters of which increase in opposite directions, FIG. 4 a schematic illustration of a double cone refiner in accordance with the invention with an outwardly pivotable inner stator, FIG. 5 an illustration of the double cone refiner of FIG. 4 in which the outer stator halves are also shown in the outwardly pivoted state, FIG. 6 a schematic partial illustration of milling tools with rapid securing members adapted to suit the apparatus of the invention, FIG. 7 a first variant of a way of securing end segments for milling tools of the kind shown in FIG. 6, and FIG. 8 a second variant of a possible way of securing end segments by means of a wedge strip.

The schematic illustration of FIG. 1 shows a housing 1 in which a rotor 2 with a conical surface is journalled and is driveable via a shaft 15. An inner milling gap 11 formed by oppositely disposed milling tools 12 is formed between the conical inner surface 8 of the rotor 2 and the counter surface 9 of complementary shape of a stator 3 which is fixedly mounted relative to the housing.

Between the conical outer surface 7 of the rotor 2 and a counter surface 9 of complementary shape of an axially displaceable housing insert 4 there is in turn formed an outer milling gap 10 which is provided with corresponding milling tools 12.

The milling gaps 10, 11 are radially spaced apart and arranged in the axial direction in essentially the same range or region. The pressing forces in the milling gaps 10, 11 are generated by the possibility of adjustment of the housing insert 4 indicated by means of a double arrow, with the rotor 2 which is floatingly journalled at one end being able to adjust itself at will between the housing insert 4 operating as a stator body and the inner stator 3 which is fixedly arranged in the housing 1 and thereby journalled in a force-free manner in the axial direction.

The drive of the rotor 2 indicated by the drive shaft 15 can also take place from the opposite side.

The fibre material suspension to be milled is supplied to the two milling gaps 10, 11 from the side of the arrow 35 and it emerges again out of the two milling gaps 10, 11 in accordance with the arrows 36 and can be discharged out of the apparatus via a discharge line.

Figure 2:
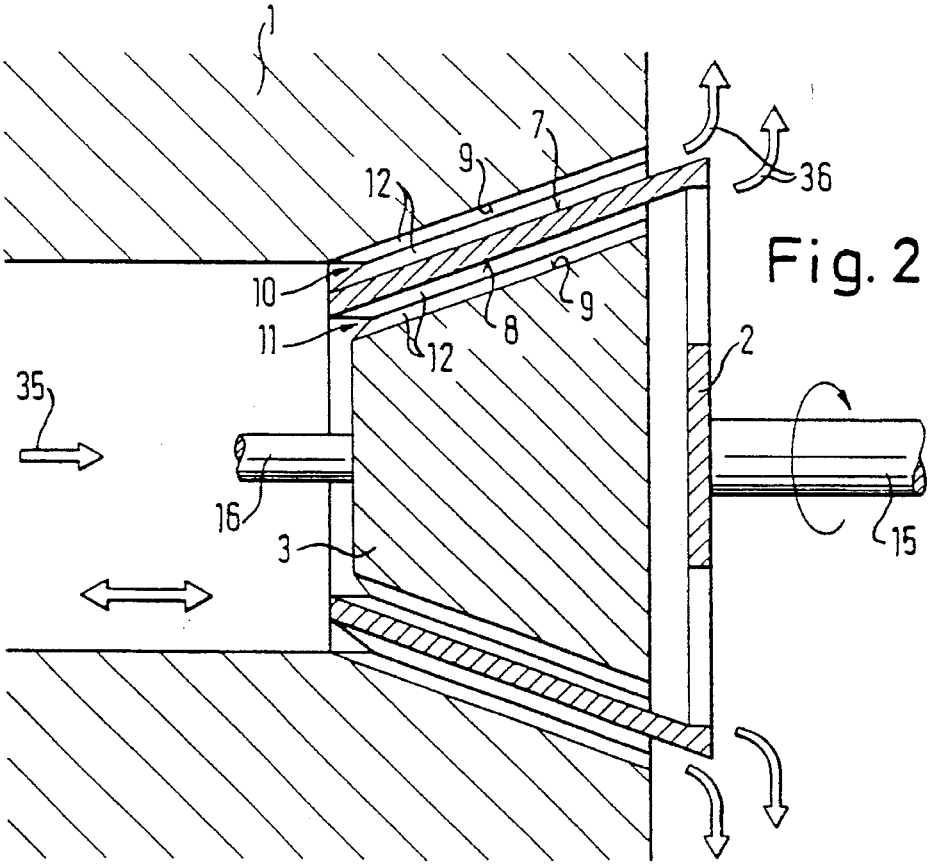

The variant of FIG. 2 is distinguished from the embodiment of FIG. 1 essentially only in that the pressing forces in the milling gaps 10, 11 are not generated via an axially adjustable housing insert but rather via the axially adjustable inner stator 3.

In both cases the floatingly journalled rotor 2 however ensures substantially identical conditions in the two milling gaps 10 and 11, thereby relieving the rotor bearing.

In both cases the flow of fibrous material which is supplied is split up into two partial flows, is lead through the two milling gaps 10, 11 and these two partial flows are then combined together again and led out of the apparatus.

Figure 3:
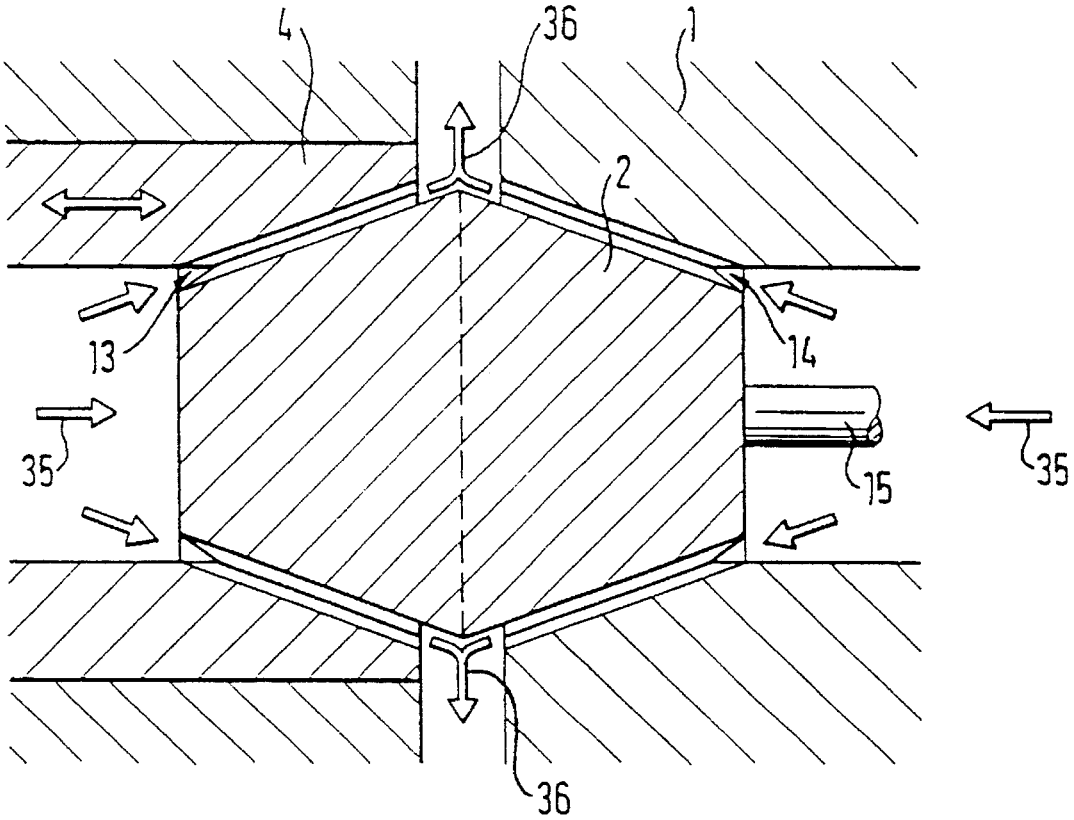

FIG. 3 shows an embodiment of the invention in which two milling gaps 13, 14 which follow one another in the axial direction and which have centrally symmetrically arranged milling cone surfaces, the diameters of which increase in opposite directions, are formed between the rotor 3 and the housing 1 and also a housing insert 4 which is axially adjustable in the housing. The supply of the fibrous material takes place in accordance with the arrows 35 at both ends of the rotor and after the milling gaps 13, 14 the milled suspension is led away centrally in accordance with the arrows 36.

In this case, the influencing of the milling gaps 13, 14 by adjustment of the axially moveable housing insert 4 and the floatingly journalled rotor 2 ensures identical conditions in the two milling gaps 13, 14 and a relief of the rotor bearing.

In this embodiment, it is also possible to use a rotor bearing at both ends in place of a flying support or cantilever mounting.

Figure 4:
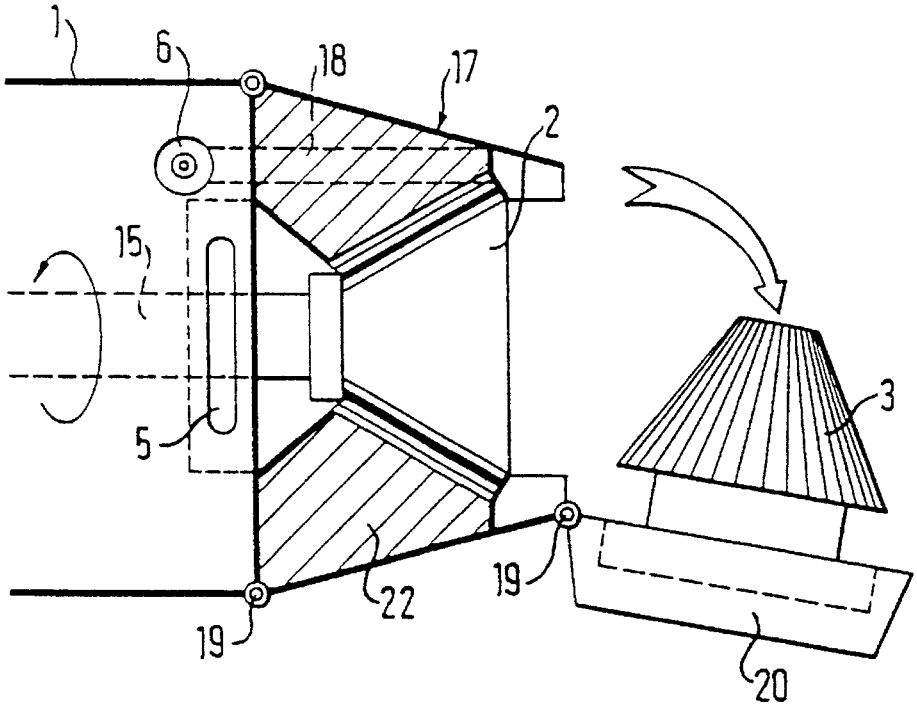
Figure 5:
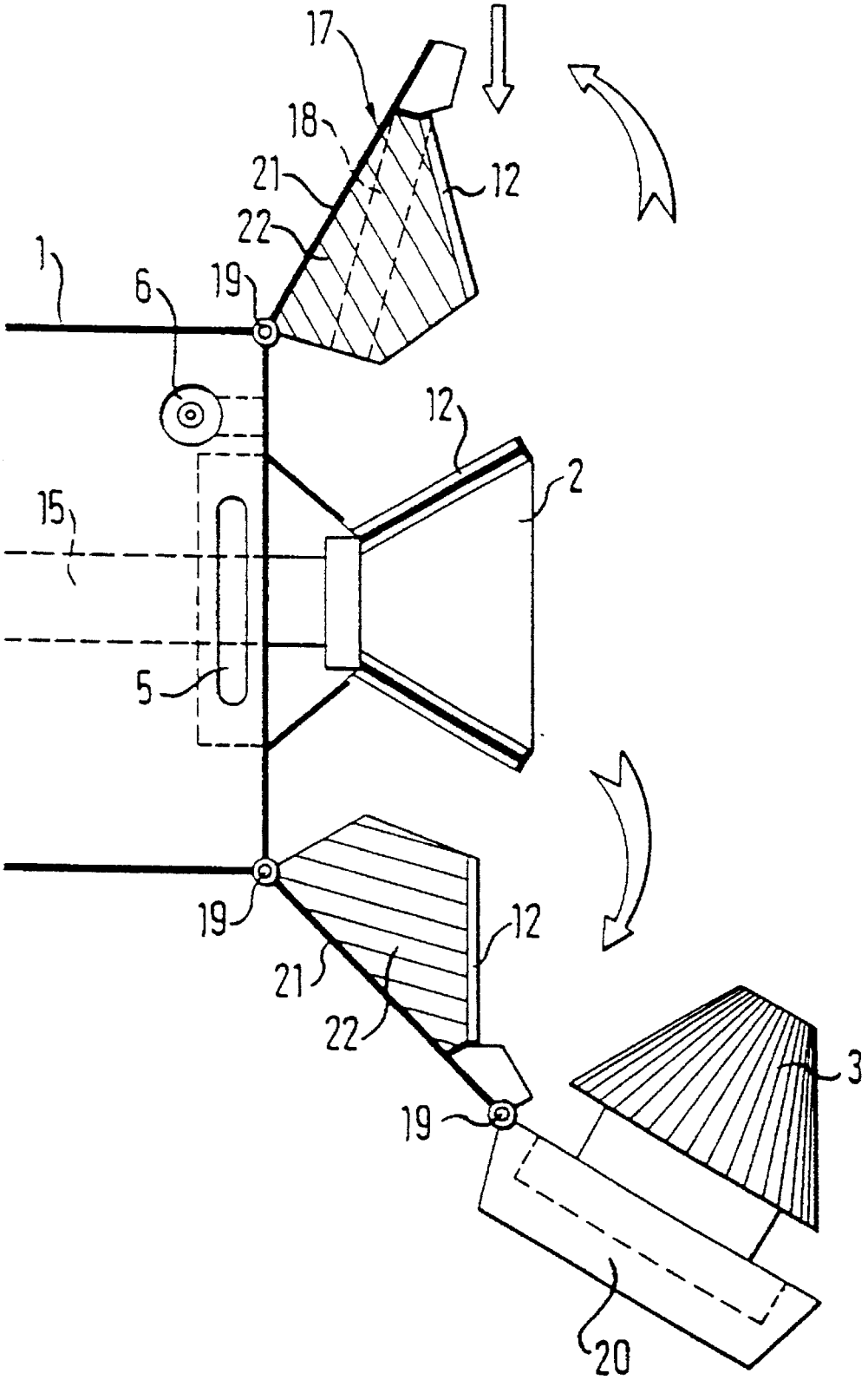

The embodiment of the invention shown in FIGS. 4 and 5 is characterised by ideal accessibility of the milling tools forming the milling gaps in the case of opening of the apparatus.

Important in this respect is that the housing is subdivided into a fixed housing part 1 and into an outwardly pivotable housing region 17. In order to ensure that the outward pivotability of the housing does not make changes necessary either to the supply of material or to the discharge of material, provision is made for both the inner opening 5 and also the outlet opening 6 for the fibrous material to be disposed in the region of the fixed housing 1. This is made possible in that a connection duct 18 or a correspondingly arranged channel is provided between the milling gap outlets, which are disposed in the outwardly pivotable housing region and the outlet opening 6 which is provided in the fixed part of the housing.

The drive shaft 15 of the rotor 2 is disposed on the side of the fixed housing 1 and the rotor 2 broadens in the direction of the pivotal lid 20, which closes off the housing. The milling gaps are formed in the above described manner between the outer surface of the rotor and a complementary counter surface on an outer stator 22, and between the inner surface of the rotor and the complementary counter surface on an inner stator 3 which is mounted on the pivotal lid 20.

In the above described manner the pressing forces in the milling gaps can be generated either through the outer stator 22 or through the inner stator 3. The inner stator 3 is preferably equipped with a corresponding adjustment unit which then acts between the pivotal lid 20 and the inner stator 3.

In accordance with an embodiment of the invention, it is sufficient to make the pivotal lid 20 outwardly pivotable via a hinge 19 since then accessibility is already achieved to the milling tools which form the inner milling gap and the tools which are associated with the outer milling gap are accessible if the rotor 2 is partly or fully extracted. The outward pivotability can be easily achieved because the inner stator 20 is axially adjustable and can thus also be moved so far in the direction towards the pivotal lid 20 that the pivoting processes which are necessary for opening and closing can be carried out unhindered.

It is however not only the pivotal lid 20 with the inner stator 3 which is preferably outwardly pivotally formed but rather, as can be seen in FIG. 5, the outer stator 22 is preferably of two-part design and can be pivoted outwardly relative to the fixed housing 1 via hinges 19. The two housing halves 21 which carry the associated outer stator halves 22 are, in this arrangement, pivotal to such an extent that all the milling tools 12 of the two milling gaps are freely accessible and can thus be cleaned and also interchanged.

The outwardly pivotable housing halves 21 and the pivotal lid 20 are fixed together and to the housing 1 preferably via clamping closures which can be actuated via pneumatic or hydraulic cylinders, electric motors or corresponding spindle drives or also via manually actuated spindles. A liquid-tight seal between the individual parts which are moveable relative to one another can take place via suitably arranged flat seals which are arranged in corresponding recesses, in particular in wedge-like recesses.

For the guidance of the flow of suspension within the housing, account is in each case taken of the fact that those surfaces which are contacted by suspension under pressure cannot exert any disturbing forces on the milling tools, or forces which do occur can be mutually cancelled.

Figure 6:
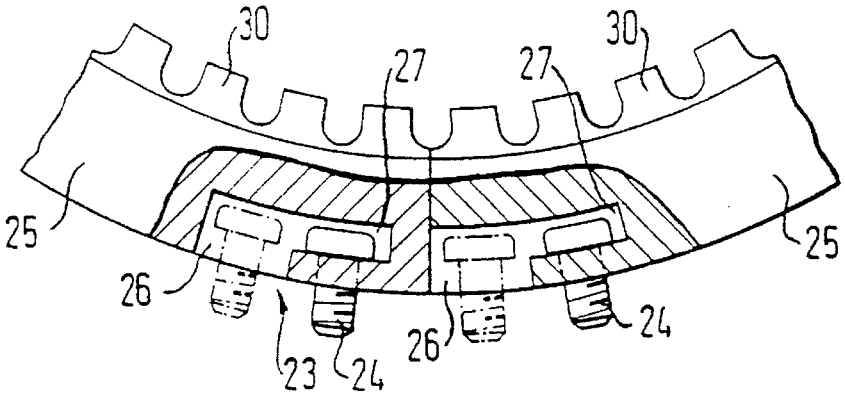
Figure 7:
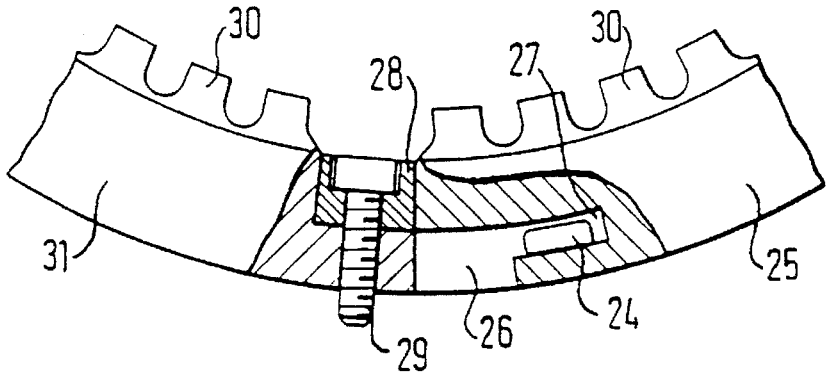
Figure 8:
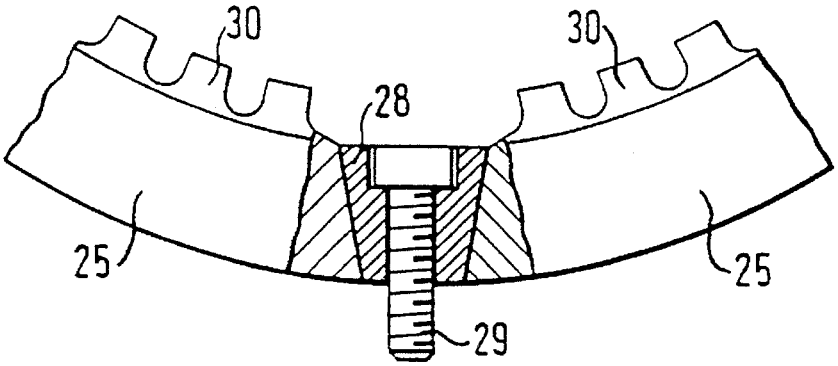

FIGS. 6 to 8 show preferred embodiments of milling tools and their mounting to the respectively associated support or mounting surface.

The milling tools which are executed in the form of cone segments 25 are provided in the customary manner with knives 30, with it being important that so far as possible the entire surface which is available is equipped with such knives, and thus the maximum possible knife-edge length is available, since this is important in the already mentioned manner for sensitive milling.

In accordance with the invention, substantially the entire milling gap side surface of the cone segments 25 is available for the knives 30 because the mounting is provided at the rear side of the cone segments 25 and indeed via rapid coupling members 23 consisting of a recess which is formed by a fixing bolt entry region 26 and a coupling region 27.

The fixing bolts 24 which are each provided with a head are screwed into the respective mounting surface. The cone segments 25 are placed over the head parts of the fixing bolts in the slot-like fixing bolt entry regions and are then so displaced that they engage beneath the fixing bolt heads in the coupling region 27 and the cone segments 25 are fixed in their desired positions.

Since a full-surface cone must be formed from the cone segments it is necessary that in each case the last segment is shaped differently in order to ensure that it can be inserted and fixed. This is possible in different ways.

FIG. 7 shows one way of securing the last cone segment 31 which is provided at the knife side, with a recess for the reception of a fixing strip 28 which can be secured by means of screws 29 to the associated mounting surface and which thus holds the termination segment 23 against the mounting surface and ensures that all other segments are held in the coupled position.

The embodiment of FIG. 8 shows an alternative end-segment mounting by means of a wedge-shaped fixing strip 28 which is likewise fixed by means of screws 29 to the associated mounting surface and presses the adjoining segments against the mounting surface, and on the other hand prevents relative movements between the remaining segments.

We claim:

1. An apparatus for comminuting fiber material comprising:

a housing having inlet and outlet openings for the fiber material, the outlet opening having a first counter surface with a plurality of milling tools disposed thereon;

a driveable rotor having first and second end portions with the first end portion floatingly journalled to the housing, the rotor including inner and outer conical surfaces and a plurality of milling tools on the inner and outer surfaces, the outer conical surface and the conical surface of the housing forming a first milling gap therebetween; and a stator having a second counter surface complementary to the inner surface of the rotor and a plurality of milling tools on the second counter surface, the second counter surface and the rotor inner surface being adjustable relative to each other and forming a second milling gap therebetween, the first milling gap being radially spaced from the second milling gap, the first and second milling gaps extending a substantially equivalent distance in the axial direction and being in communication with the outlet opening of the housing for receiving the fiber material therethrough.

2. The apparatus of claim 1 wherein the milling gaps are disposed at substantially equivalent axial positions relative to the housing, the first and second counter surfaces being rotationally fixed and the second counter surface being axially adjustable relative to the rotor surfaces.

3. The apparatus of claim 1 wherein the milling gaps are disposed at substantially equivalent axial positions relative to the housing and the housing includes an axially displaceable insert, the first counter surface being disposed on the insert.

4. The apparatus of claim 1 wherein the rotor is a hollow conical rotor.

5. The apparatus of claim 4 wherein the rotor includes a drive shaft extending towards the inlet opening of the housing, the stator engaging the rotor on a side opposite the drive shaft.

6. The apparatus of claim 1 wherein the housing comprises a stationary portion and at least one movable portion hingedly coupled to the stationary portion to expose the milling tools on at least the rotor inner surface.

7. The apparatus of claim 6 wherein the milling gaps each have an inlet in communication with the outlet opening of the housing and an outlet for discharging the fiber material, the housing further including at least one duct fluidly coupling the outlet opening with the outlets of the milling gaps.

8. The apparatus of claim 6 wherein the movable portion includes a lid for supporting the stator, the lid being pivotally coupled to the movable portion of the housing.

9. The apparatus of claim 8 means for axially displacing the stator.

10. The apparatus of claim 6 wherein the movable portion includes first and second supports pivotally coupled to the stationary portion, the housing further including a lid for supporting the stator, the lid being pivotally coupled to the first support.

11. The apparatus of claim 10 further including fluid sealing elements for latching the lid to the first support and the first and second supports to the stationary portion of the housing.

12. The apparatus of claim 1 wherein the milling tools comprise a plurality of segments each having a plurality of knives on one side and coupling members on an opposing side, the apparatus further including bolts that form lock the coupling members to the rotor and counter surfaces.

13. The apparatus of claim 12 wherein the coupling members are formed by recesses in the segments, the recesses each comprising an entry region for receiving one of the bolts and a slot for sliding said one of the bolts therethrough to thereby couple the bolt to the coupling member.

14. The apparatus of claim 1 wherein the milling tools comprise a plurality of segments each having a plurality of knives on one side and coupling members on an opposing side, the apparatus further including a plurality of fixing strips arranged in a form fitting manner between adjacent segments, the fixing strips being secured to the rotor, the stator and the housing via screws.

15. An apparatus for comminuting fiber material comprising:

a housing having at least one inlet opening and first and second axially sequential outlet openings for the fiber material, the outlet openings each having a counter surface with a plurality of milling tools disposed thereon, one of the outlet openings comprising an axially displaceable insert such that one of the counter surfaces is axially movable relative to the other of the counter surfaces; and a driveable rotor journalled to the housing, the rotor including first and second conical surfaces and a plurality of milling tools on the conical surfaces, the conical surfaces and the counter surfaces of the housing forming first and second conical milling gaps therebetween, the first and second milling gaps extending a substantially equivalent distance in the axial direction and being in communication with the outlet openings of the housing for receiving the fiber material therethrough.

16. An apparatus for comminuting fiber material comprising:

a housing having at least one inlet opening and at least one outlet opening for the fiber material, the housing including an axially displaceable insert having a counter surface with a plurality of milling tools disposed thereon; and a driveable rotor journalled to the housing, the rotor including first and second conical surfaces and a plurality of milling tools on the conical surfaces, the first conical surface and the counter surface of the insert forming a first conical milling gap therebetween; and a stationary element having a counter surface complementary to the second conical surface of the rotor to form a second milling gap therebetween, the first and second milling gaps extending a substantially equivalent distance in the axial direction and being in communication with the outlet opening of the housing for receiving the fiber material therethrough.

* * * * *